US010463181B2

(12) United States Patent
Kaupp

(10) Patent No.: US 10,463,181 B2
(45) Date of Patent: Nov. 5, 2019

(54) DISPOSABLE CAKE PROTECTOR

(71) Applicant: Ronald John Kaupp, San Rafael, CA (US)

(72) Inventor: Ronald John Kaupp, San Rafael, CA (US)

( * ) Notice: Subject to any disclaimer, the term of this patent is extended or adjusted under 35 U.S.C. 154(b) by 218 days.

(21) Appl. No.: 15/732,091

(22) Filed: Sep. 15, 2017

(65) Prior Publication Data

US 2019/0082870 A1 Mar. 21, 2019

(51) Int. Cl.
*A47G 19/26* (2006.01)

(52) U.S. Cl.
CPC ..... *A47G 19/26* (2013.01); *A47G 2400/061* (2013.01)

(58) Field of Classification Search
USPC ..... 99/645
See application file for complete search history.

(56) References Cited

U.S. PATENT DOCUMENTS 1,707,539 A * 4/1929 Propp ..... G09F 13/00 108/23
2,960,770 A * 11/1960 Valenta ..... A47G 19/00 33/1 F
D267,191 S * 12/1982 Harrison ..... D23/280.1
4,884,966 A * 12/1989 Wexler ..... A47G 19/26 431/295
D733,502 S * 7/2015 Hill ..... D7/610
2003/0136277 A1* 7/2003 Okros ..... A47G 19/26 99/645
2006/0000741 A1* 1/2006 Flanagan ..... A47G 19/26 206/527
2006/0078838 A1* 4/2006 McLemore ..... A21C 15/00 431/253
2007/0048680 A1* 3/2007 Cartledge ..... A47G 19/26 431/126
2008/0268392 A1* 10/2008 Bern ..... A47G 19/00 431/295
2008/0272019 A1* 11/2008 Miller ..... B65D 81/365 206/457
2009/0053663 A1* 2/2009 Okros ..... A47G 19/26 431/295
2009/0181335 A1* 7/2009 Tropeano ..... F21S 13/14 431/253
2012/0167784 A1* 7/2012 Zeigler ..... A47G 19/26 99/645
2012/0247996 A1* 10/2012 Donnelly ..... A47G 19/26 206/457
2014/0272743 A1* 9/2014 Hill ..... A47G 19/26 431/295

FOREIGN PATENT DOCUMENTS

GB 2197453 A * 5/1988 ..... F21V 35/00

* cited by examiner

*Primary Examiner* — Nina Bhat
(74) *Attorney, Agent, or Firm* — Savantek Patent Services

(57) ABSTRACT

A free-standing disposable cake protector with a plurality of extendable foldable legs, a transparent top panel and a flexible transparent side wall. The top panel includes sockets capable of accepting birthday candles. The extension legs can be extended or retracted to accommodate the height of the cake being protected. The foldable legs with the fixedly attached side panel provide means to transport and store the cake protector in compact flat configuration. The cake protector provides protection from candle wax and from exposure to saliva expelled by a person blowing candles out when the cake protector is in unfolded configuration.

4 Claims, 10 Drawing Sheets

DISPOSABLE CAKE PROTECTOR

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of bakery goods enclosures and more specifically to a disposable cake protector.

A cake is a food item that is enjoyed as a desert in many parts of the world. In the United States, it is common to place candles on top of a cake, and to light the candles, sing happy birthday and then blow the candles out.

The act of blowing the candles out is problematic in that the person doing the blowing may unintentionally spray the cake with potentially harmful germs or bacteria that may be contained within the stream of his or her breath that is being forcefully expelled onto the cake. Others have noticed this deficiency and have proposed various solutions.

These include rigid covers that include sockets for candles, and non-rigid covers that require stand-offs hold the top plate away from the surface of the cake. The rigid covers are relatively expensive to manufacture and are relatively bulky and therefore take up valuable retail space when being sold in a retail environment. The non-rigid covers require stand-offs to be pushed into the top surface of the cake which can harm the appearance of the cake

BRIEF SUMMARY OF THE INVENTION

The primary object of the invention is to provide a disposable cake protector that can fold flat for compact storage and transport.

Another object of the invention is to provide a disposable cake protector that can be adjusted to accommodate cakes of various heights.

Another object of the invention is to provide a disposable cake protector that can support a plurality of candles.

A further object of the invention is to provide a disposable cake protector that is inexpensive to manufacture.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a disposable cake protector comprising: a main frame, a plurality of foldable legs, a plurality of extension legs, a top panel, a flexible side wall, said main frame being made of rigid, rod-like material and sized to fit the perimeter of a particular cake dimension, said rod-like material being round in cross section, said top panel being rigid and transparent and having a C shaped perimeter configuration capable of snapping onto said main frame, said top panel including a plurality of a sockets capable of removably receiving standard birthday candles, said foldable legs having a C shaped top portion that allows said legs to be rotationally connected to said main frame, said foldable legs being hollow, said extension legs each slidably fitting within each said hollow leg, said flexible side wall fixedly attached to the inner wall of each said foldable leg, so that when said foldable legs are unfolded to a ninety degree angle with respect to the main frame, said flexible side wall unfolds to match the side wall of the cake that it is protecting and said extension legs can be extended or retracted to accommodate the height of the cake being protected.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
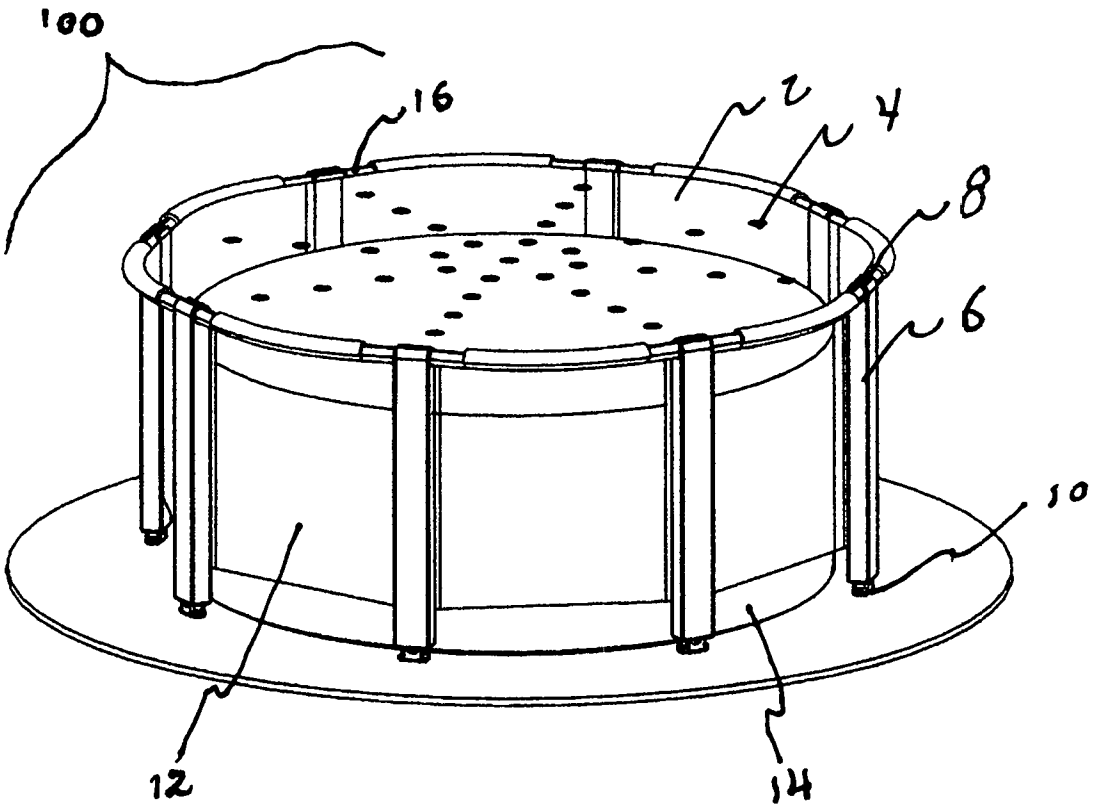
FIG. 1 is a perspective view of the invention with cover in place.

Referring to FIG. 1 we see a perspective view of the invention 100 in the use position. A top panel 2 is fastened to a frame member 16. The frame member 16 has a round cross section. Rotatable legs 6 include a C shaped rotating hinge portion 8 located at the top of each leg 6 to allow legs 6 to rotate to an open position, that is the legs are perpendicular to the top panel, or closed position, that is the legs are parallel to the top panel. A thin plastic side surround panel 12 is attached to the inner wall of each leg 6 and the frame member 16. The combination of the top panel 2 and the surround panel 12 protects the circular cake 14 located within the side surround panel 12. The top panel 2 includes a plurality of receptacle sockets 4 for receiving standard birthday candles. The top panel 2 and the side surround panel 12 are both transparent, so that the exterior decorations on the cake 14 can be easily seen. The cake 14 is not in any way marred or disturbed by the cake cover 100 because the legs 6 and frame member 16 extend beyond the circumference and height of the cake 14. The top panel 2 is made of very thin thermoformed transparent plastic; preferably PET type plastic which is food grade.

Figure 2:
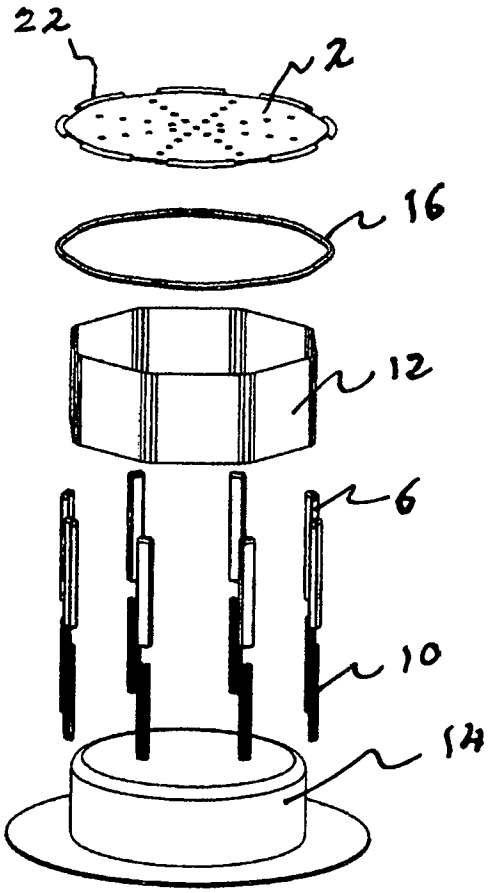
FIG. 2 is an exploded view of the invention.

FIG. 2 is an exploded view of the invention 100. Top panel 2 is attached to frame member 16 via C shaped perimeter pieces 22. Side surround panel 12 is attached at each leg 6 and to frame member 16. Legs 6 are hollow and can accept extension legs 10 thereby allowing the cake cover 100 to be made taller for taller cakes 14.

Figure 3:
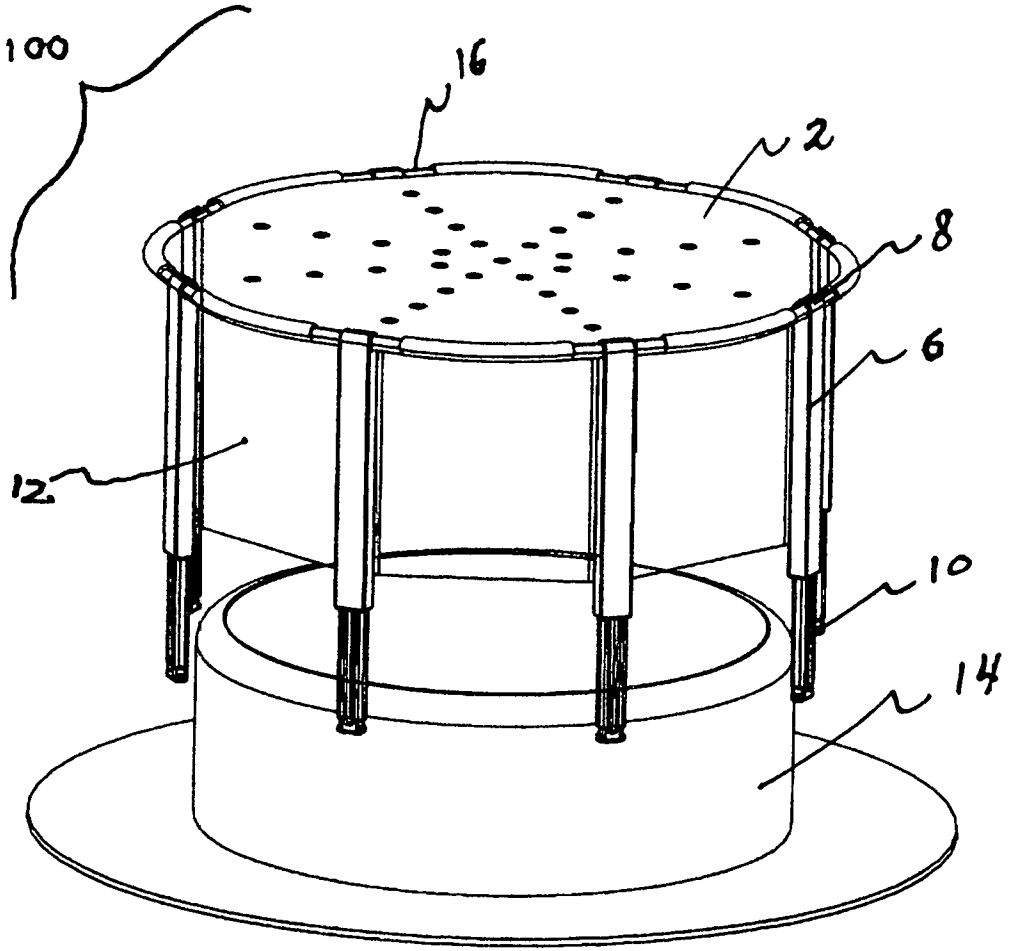
FIG. 3 is a perspective view of the invention with the extendable legs pulled out.

FIG. 3 shows the invention 100 ready to be installed on top of a circular cake 14 the extension legs 10 have been extended from hollow legs 6 to allow for a tall cake.

Figure 4:
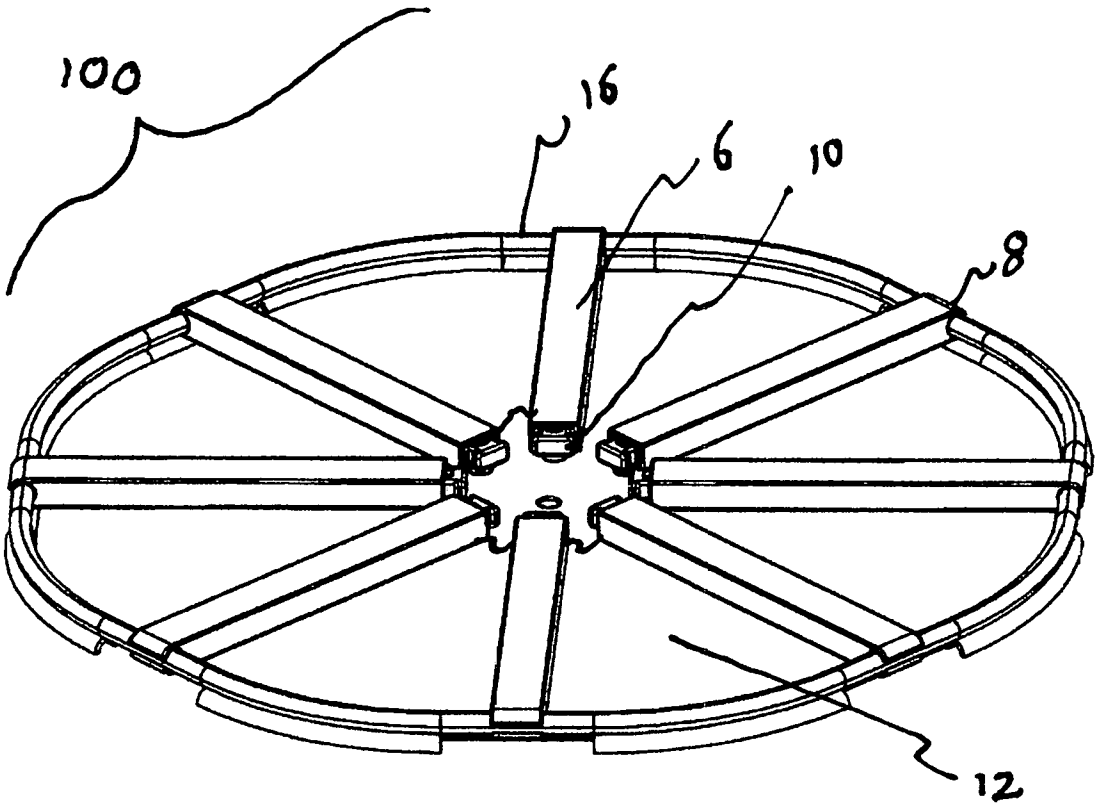
FIG. 4 is a perspective view of the invention in the folded for storage position.

FIG. 4 is a perspective view of the invention 100 in the closed or stored position. The ability of the legs 6 to rotate ninety degrees allows for a very flat final configuration which is ideal for storage, shipping and for taking up a minimum of space in a retail store environment, which is very important to retailers who value every square foot of floor space. The invention 100 is made of relatively inexpensive materials including thin walled plastic injection molded legs 6, 10 and an approximately thirty thousandths of an inch-thick transparent top panel 2 that is thermoformed to include the perimeter C shaped configuration and the sockets for candles. The surround panel is made of very thin flexible poly film material approximately three thousandths of an inch thick. The total cost of the invention 100 is estimated at approximately fifty cents, making the estimated retail cost approximately two dollars, which is a price that consumers are willing to pay for a disposable item that protects party goers from potential airborne disease.

Figure 5:
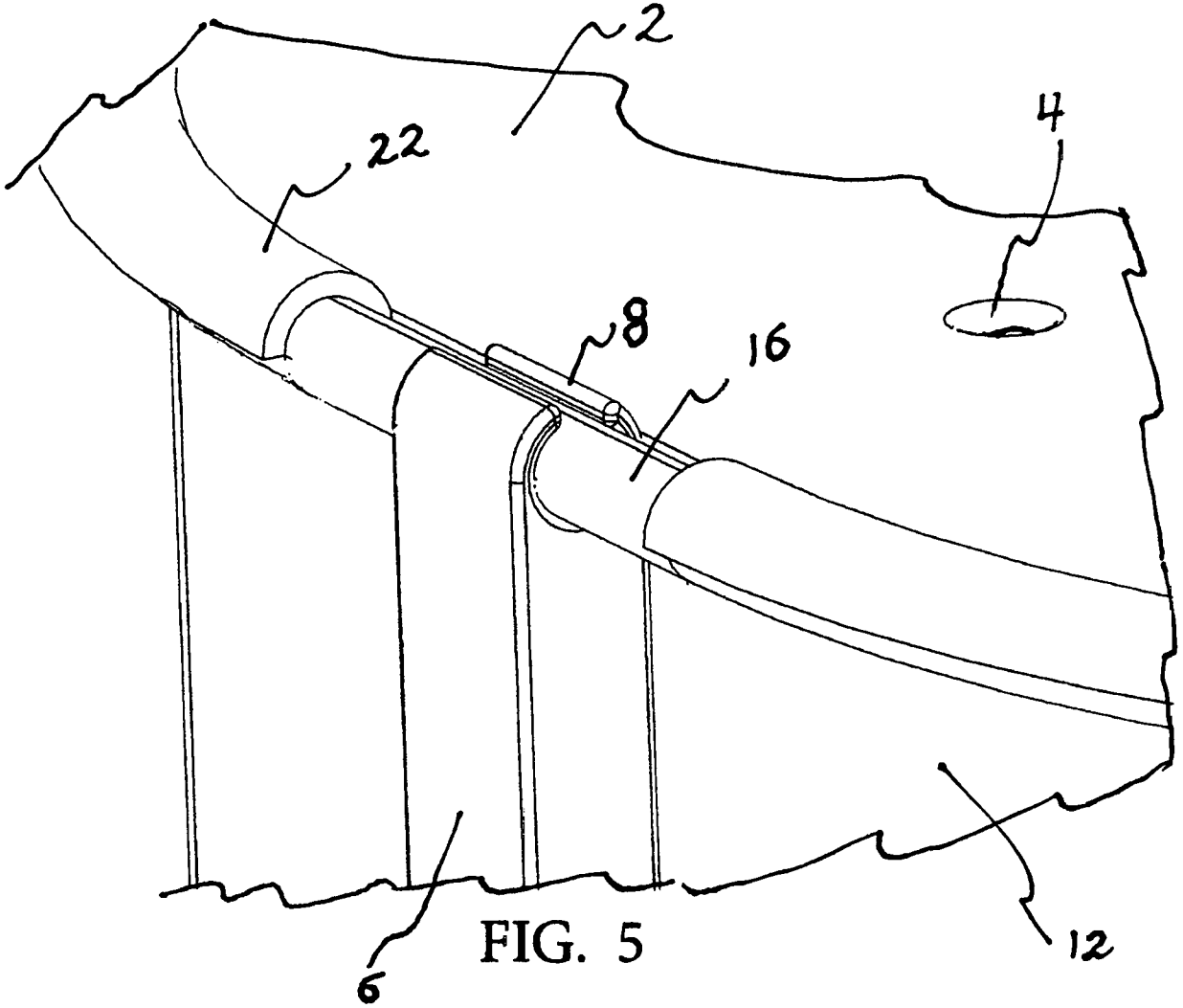
FIG. 5 is a partial perspective view of the leg folding hinge.

FIG. 5 is a partial perspective view of the invention showing the C shaped hinge 8 that is located at the top of each leg 6 and which allows the leg 6 to rotate about the circular cross section frame member 16. The C shaped perimeter 22 of top panel 2 is fixedly attached by standard means to frame member 16.

Figure 6:
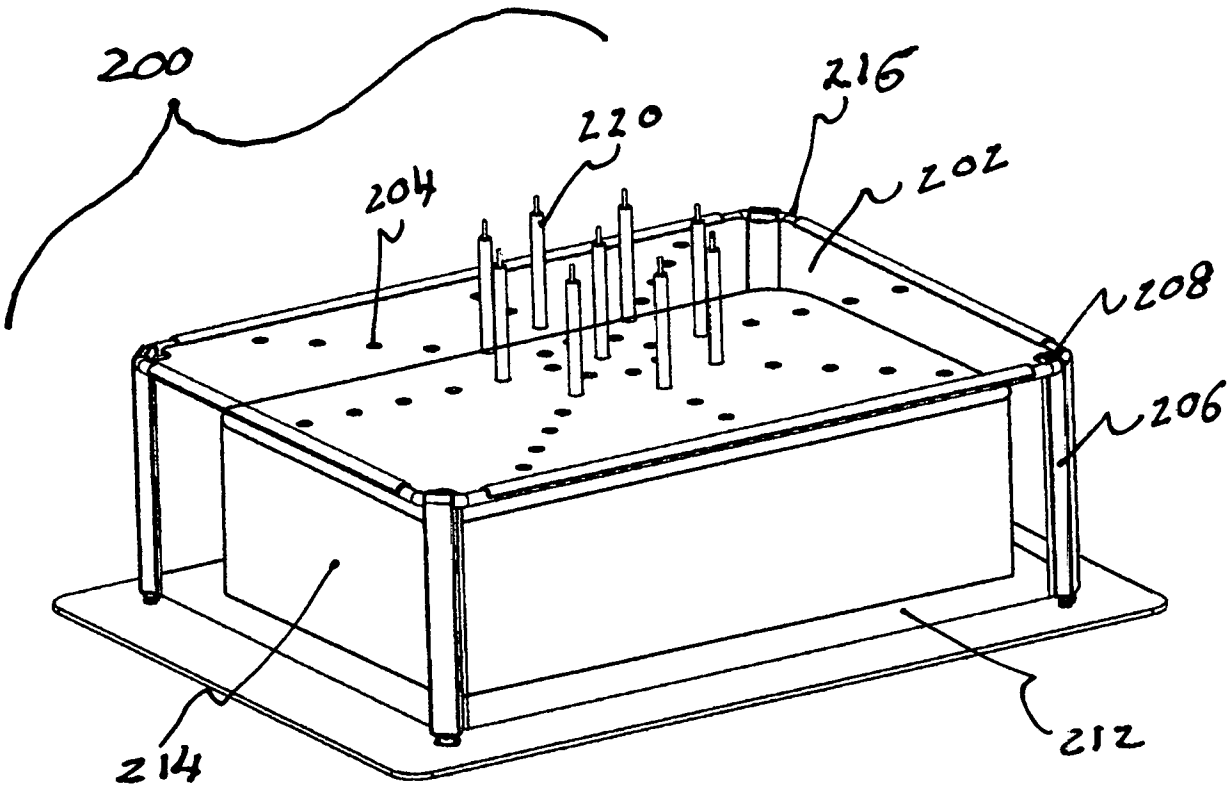
FIG. 6 is a perspective view of a rectangular embodiment of the invention in the use position.

FIG. 6 is a perspective view of an alternate embodiment of the invention 200. This embodiment is designed for a sheet cake 214, which is rectangular in shape. The top panel 202 and main frame 216 are rectangular in shape. The legs 206 fold down in a similar way as the legs 6 in the circular design 100. Sockets 204 can accept candles 220 as in the circular design 100.

Figure 7:
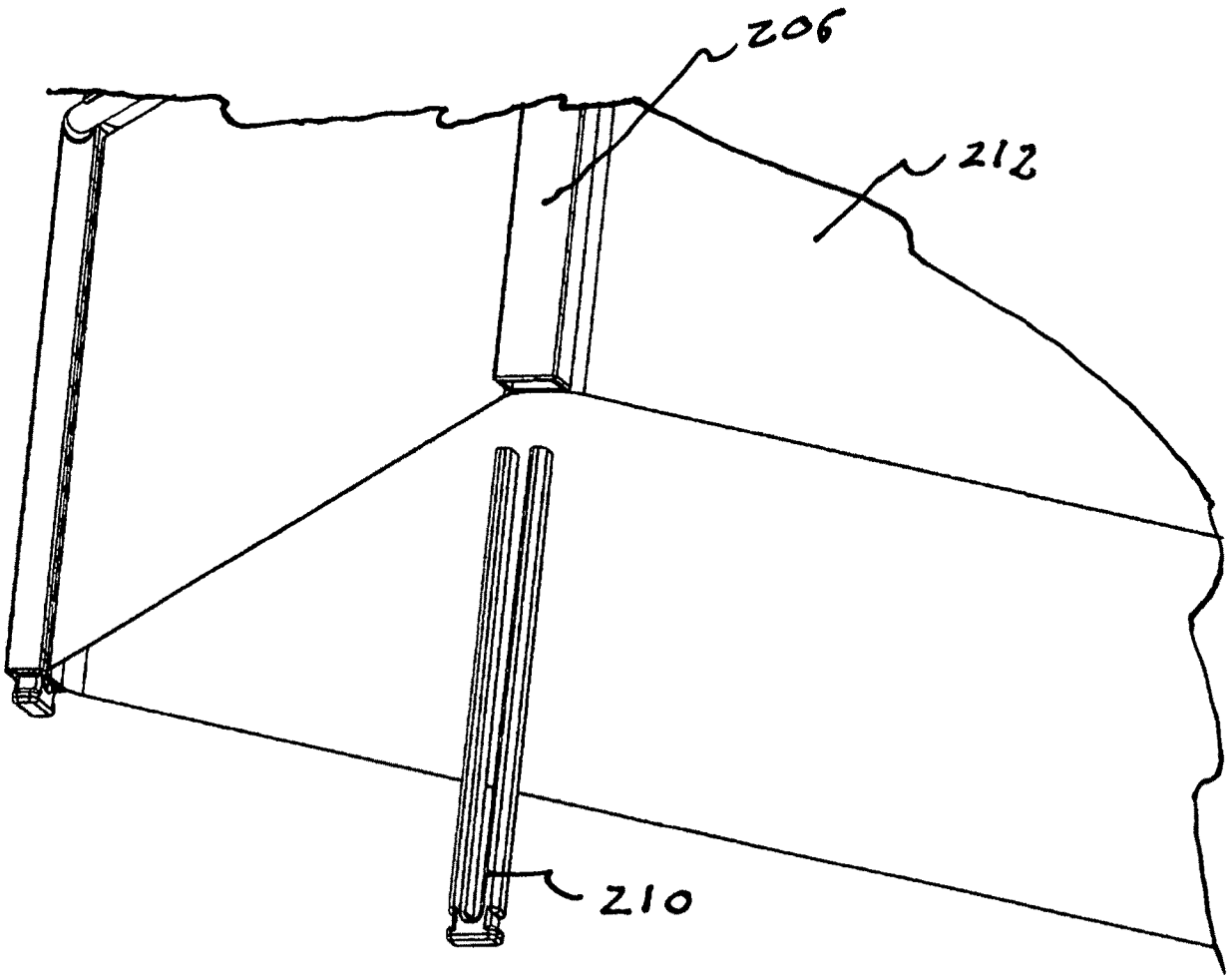
FIG. 7 is a partial exploded view of the extendable leg.

FIG. 7 is a partial perspective view showing extension leg 210 about to be plugged into hollow main leg 206 in a similar fashion to the extension leg 10 in the circular embodiment 100.

Figure 8:
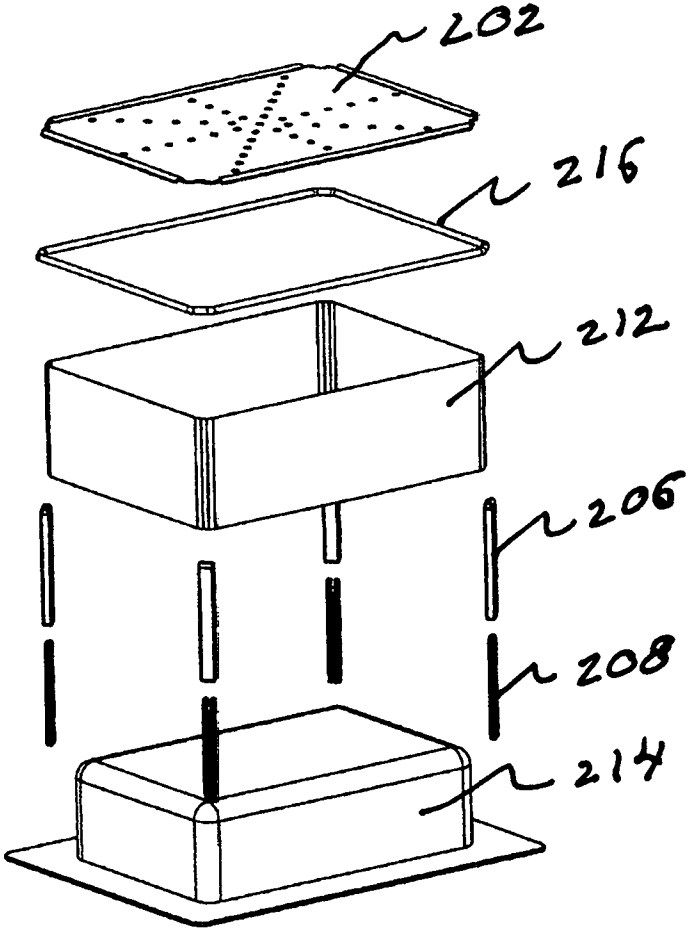
FIG. 8 is an exploded view of the rectangular embodiment of the invention.

FIG. 8 is an exploded view of the alternate embodiment 200. Flexible side panel 212 is attached to legs 206 in a similar way as in the circular version 100.

Figure 9:
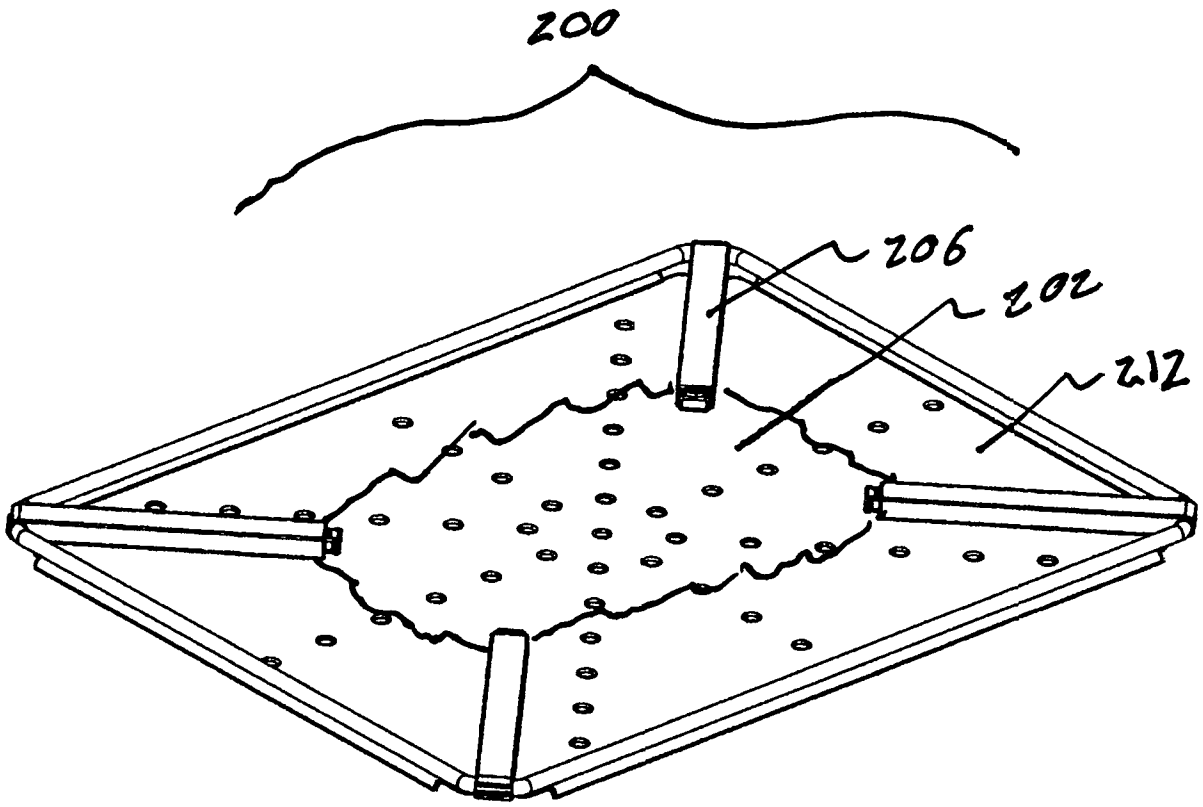
FIG. 9 is a folded for storage view of the rectangular embodiment of the invention.

FIG. 9 is a perspective view of the alternate embodiment 200 in the closed or stored position. Side panel 212 is folded flat against top panel 202. Legs 206 are folded flat on top of side panel 212 and top panel 202.

Figure 10:
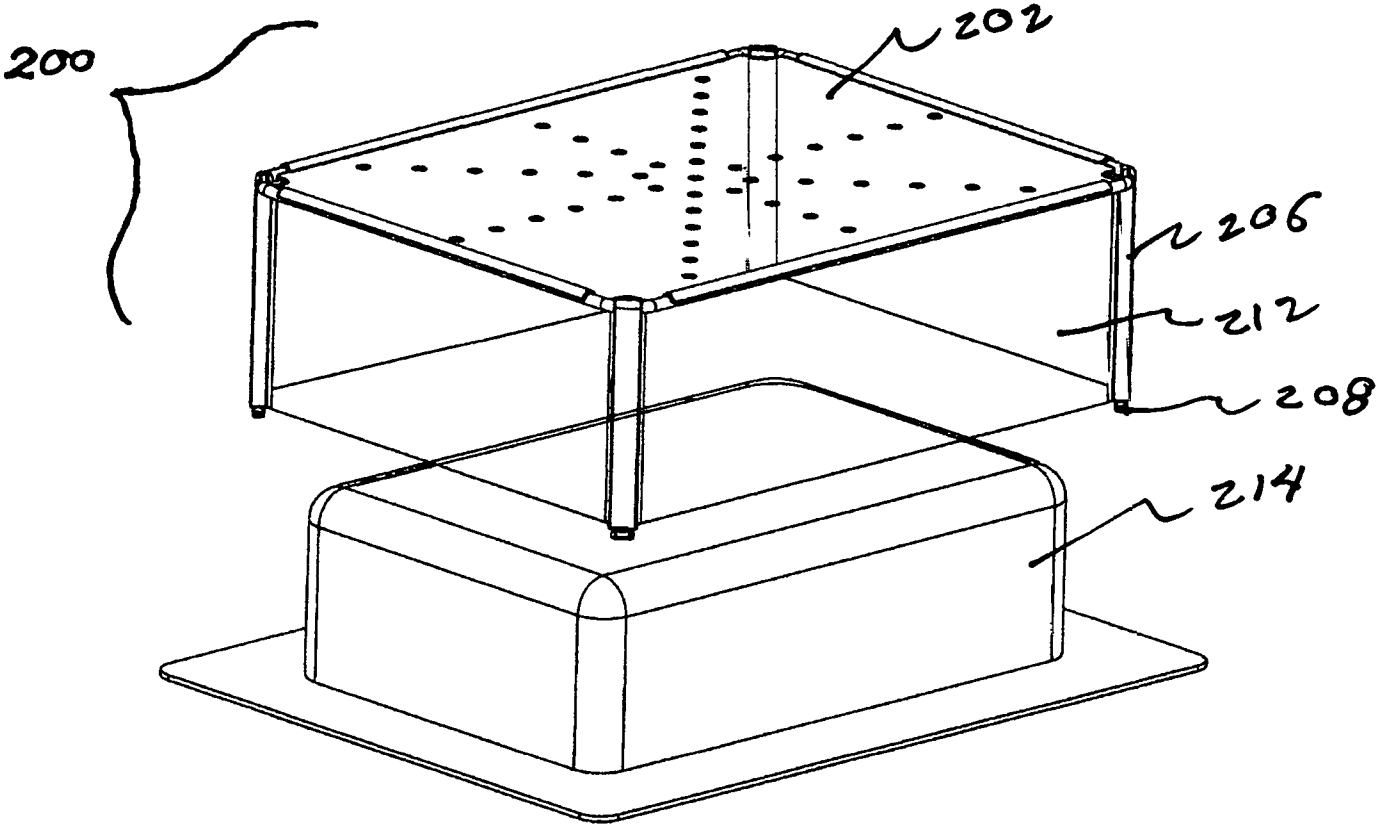
FIG. 10 is a perspective view of the rectangular embodiment of the invention ready to be installed on top of a rectangular cake.

FIG. 10 is an exploded view of the alternate embodiment 200 ready to be placed over cake 214. Both the circular embodiment 100 and the rectangular embodiment 200 can be manufactured in a variety of sizes to fit all common round and rectangular cakes or other baked goods.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. Disposable cake protector comprising:

a main frame;

a plurality of foldable legs;

a plurality of extension legs;

a top panel;

a flexible side wall;

said main frame being made of rigid round cross section material wherein the dimensions of the main frame consist of the dimensions of the protected cake extended by the amount necessary to clear the protected cake when deployed;

wherein the transparent rigid top panel comprises and insert snaps which connects the C-shaped perimeter of said main frame;

said top panel comprising a plurality of sockets for receiving, holding and releasing standard birthday candles;

wherein said foldable legs top portion rotationally connect to said C-shaped perimeter of said main frame;

wherein said foldable legs are hollow in construction;

wherein each extension leg is slidably inserted within each hollow leg to accommodate the height of the protected cake; and said flexible side wall is fixedly attached to the inner wall of each foldable leg, wherein said flexible sidewall when unfolded is parallel to said cake side wall when said foldable leg is rotated.

2. A disposable cake protector as claimed in claim 1 wherein said main frame is rectilinear in shape to accommodate a standard sheet cake.

3. A disposable cake protector as claimed in claim 1 wherein said main frame is circular in shape to accommodate a cylindrically shaped cake.

4. A disposable cake protector as claimed in claim 1 wherein the cake protector is collapsed into a compact form wherein said legs are rotated parallel to the top of the cake protector.

* * * * *